US005205115A

United States Patent [19]

Plemmons et al.

[11] Patent Number: 5,205,115

[45] Date of Patent: Apr. 27, 1993

[54] GAS TURBINE ENGINE CASE COUNTERFLOW THERMAL CONTROL

[75] Inventors: Larry W. Plemmons, Fairfield; Robert Proctor, West Chester, both of Ohio; Robert J. Albers, Park Hills, Ky.; Donald L. Gardner, West Chester, Ohio

[73] Assignee: General Electric Company, Cincinnati, Ohio

[21] Appl. No.: 787,498

[22] Filed: Nov. 4, 1991

[51] Int. Cl.[5] ..... F02C 3/00

[52] U.S. Cl. ..... 60/39.75; 415/115; 415/173.1

[58] Field of Search ..... 60/39.75, 39.29, 266, 60/267; 415/115, 116, 117, 173.1, 178

[56] References Cited

U.S. PATENT DOCUMENTS

| | | | |
|---|---|---|---|
| 2,801,821 | 8/1957 | Burger | 415/178 |
| 4,019,320 | 4/1977 | Redinger, Jr. et al. | 60/266 |
| 4,363,599 | 12/1982 | Cline et al. | 415/136 |
| 4,553,901 | 11/1985 | Laurello | 60/39.75 |
| 4,627,233 | 12/1986 | Baran, Jr. | 415/115 |
| 4,696,619 | 9/1987 | Lardellier | 415/138 |
| 4,826,397 | 5/1989 | Shook et al. | 415/116 |
| 4,841,726 | 6/1989 | Burkhardt | 60/39.75 |
| 4,859,142 | 8/1989 | Burke et al. | 415/116 |

FOREIGN PATENT DOCUMENTS

| | | | |
|---|---|---|---|
| 2151711 | 7/1985 | United Kingdom | 415/173.1 |

*Primary Examiner*—Richard A. Bertsch
*Assistant Examiner*—Michael I. Kocharov
*Attorney, Agent, or Firm*—Jerome C. Squillaro; John R. Rafter

[57] ABSTRACT

A thermal control apparatus is provided for gas turbine engine cases and particularly for thermal control of clearances between turbine rotors and surrounding shrouds. Thermal control of an annular case section or ring is provided by counterflowing two heat transfer fluid flowpaths in heat transfer communication with the section of engine casing. The flowpaths may be in parallel or series such that there is substantially no circumferential gradient in the mass flowrate weighted average temperature of the heat transfer fluid supplied by the two counterflowing fluid flowpaths. One embodiment provides forward and aft rings cooled by three spray tubes in each of two 180° sectors whereby the forward and aft spray tubes flow thermal control air flowing in one circumferential direction and the middle spray tubes flows thermal control air in an opposite circumferential direction.

12 Claims, 6 Drawing Sheets

GAS TURBINE ENGINE CASE COUNTERFLOW THERMAL CONTROL

BACKGROUND OF THE INVENTION

1. Field of the Invention

The invention relates to thermal control of gas turbine engine cases and particularly for thermal control of clearances between turbine rotors and surrounding shrouds by counterflowing air used for heat transfer around the engine.

2. Description of Related Art

Rotor clearance control systems that incorporate heating and cooling to effect thermal control of shrinkage and expansion of different parts of gas turbine engine cases are used for aircraft gas turbine engines to reduce leakage losses and improve specific fuel (SFC) consumption of the engines. One example of such an apparatus can be found described in U.S. Pat. No. 4,826,397, entitled "Stator Assembly for a Gas Turbine Engine", by Paul S. Shook and Daniel E. Kane. Reference may be had to this patent, by Shook et al, for background information and, for this reason, it is incorporated herein by reference. Shook discloses a clearance control system that uses spray tubes that spray air ducted from the engine's fan or compressor to cool turbine engine case rings in order to thermally control the clearance between an engine turbine rotor section and a corresponding stator section shroud disposed around the turbine rotor section. The Shook patent attempts to control circumferential thermal gradients around the rings, or rails as they are referred to in the patent, by shielding and insulating the rails. The shielding does not eliminate the circumferential gradient but does reduce the magnitude and severity of the gradient and therefore the stress and clearance variation that such a severe circumferential thermal gradient causes.

However spray tubes behave as heat exchangers and a circumferential variation in the temperature of the heat transfer fluid cannot be avoided nor the attendant problems associated with such a circumferential variation as shown in the prior art. The circumferential variation in the temperature of the air used to thermally control the rings produces unequal expansion and contraction of the rings particularly during transient operation of the engine such as during take-off.

The circumferential temperature variation produces a mechanical distortion of the engine casing or rings associated with the casing commonly referred to as an out of round condition. Such out of round conditions further leads to increased rubbing of the rotor and its corresponding stator assemblies such as between rotor blades and surrounding stator shrouds or between rotating and static seal assemblies. The out of round condition causes increased operating clearances, reduced engine performance, a deteriorating engine performance, and reduced component efficiency. Often difficult and expensive machining of circumferential variations in the static parts is employed during the manufacturing of the casing components to compensate for the operational circumferential variations in the thermal control air.

Another example of a clearance control system is found described in U.S. Pat. No. 4,363,599, entitled "Clearance Control", by Larry D. Cline et al assigned to General Electric the assignee of the present invention, that discloses the use of control rings integrated into the turbine casing and supporting a turbine shroud that surround and seals about turbine rotor blades. Thermal control air is supplied to the rings to effect thermally induced clearance control between the turbine blade tips and the surrounding shroud. Thermal control air is supplied to the rings from an area surrounding the combustor and through axial extending passages in the casing and through the rings.

A General Electric CF6-80C2 turbofan gas turbine engine incorporates a case flange assembly as depicted in FIGS. 6, **6*a*, and 6*b*, labelled as prior art, having a turbine shroud thermal control ring 220 bolted between a compressor case flange 210 and a turbine case flange 216. Compressor flange 210 and turbine flange 216 have compressor and turbine flange cooling air grooves 260*a* and 260*b* respectively facing thermal control ring 220. Cooling air is fed into compressor flange cooling air groove 260*a* through a radial inlet slot 270*a* which is cut through compressor flange 210 to groove 260*a***.

Compressor and turbine flanges have bolt holes 226 which snugly receive bolts 240. Control ring 220 has alternating bolt holes 226 and enlarged bolts holes 230 that provides a cooling air passage through control ring 220 to turbine flange cooling air groove **260*b*. Radial cooling air exhaust slots 270*b*** provide an exit for the cooling air from the flange assembly.

There are 34 bolt holes around the engine flange assembly and 17 sets of radial slots providing cooling air passages for thermal control around the ring. Cooling air is fed to the grooves at different circumferential locations thereby subject to circumferential variations in the cooling air temperature.

SUMMARY OF THE INVENTION

The present invention provides a means to thermally control a section of engine casing by counterflowing two heat transfer fluid flowpaths in heat transfer communication with the section of engine casing. The flowpaths may be in parallel or series such that there is substantially no circumferential gradient in the mass flowrate weighted average temperature of the heat transfer fluid supplied by the two counterflowing fluid flowpaths. The preferred embodiment employs forward and aft rings associated with the engine casing (the rings may be attached to the casing by bolts, welding or some other fastening means or be integral with the casing) that supports corresponding forward and aft ends of a stator assembly that may be circumferentially segmented.

One embodiment of the present invention illustrated herein provides a means for impinging cooling air onto forward and aft rings by three spray tubes in each of two 180° sectors wherein the forward and aft spray tubes have cooling air flowing in one circumferential direction and the middle spray tubes flow cooling air in an opposite circumferential direction. The middle spray tubes include impingement apertures and have sufficient flow capacity to impinge cooling air on both rings and the forward and aft spray tubes include impingement apertures to impinge cooling air onto the corresponding forward and aft rings. Two manifolds are used to supply the spray tubes wherein each manifold provides a means to counterflow thermal control air by supplying either the middle or the forward and aft spray tubes in opposite sectors and in opposite circumferential flow directions.

ADVANTAGES

The present invention substantially eliminates any circumferential temperature variation of the gas turbine engine cases and associated rings used to support stator assemblies by using two circumferentially counterflowing flowpaths in which the mass flowrate weighted average temperature of the heat transfer fluid in two flowpaths at any point around the case is substantially the same.

This advantage substantially reduces or eliminates out of round conditions and circumferential stresses found in thermally controlled cases having variations in their heat transfer fluid on the order of as little as 50°-100° F. around the case.

The present invention reduces operating clearances by minimizing rubbing between rotor blade tips and corresponding stator assemblies thereby; improving engine performance, reducing the rate of engine performance deterioration, and improving component efficiency.

The present invention provides a further advantage by allowing gas turbine engines to be designed with tighter blade tip operating clearances thereby improving the engine's design fuel efficiency.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
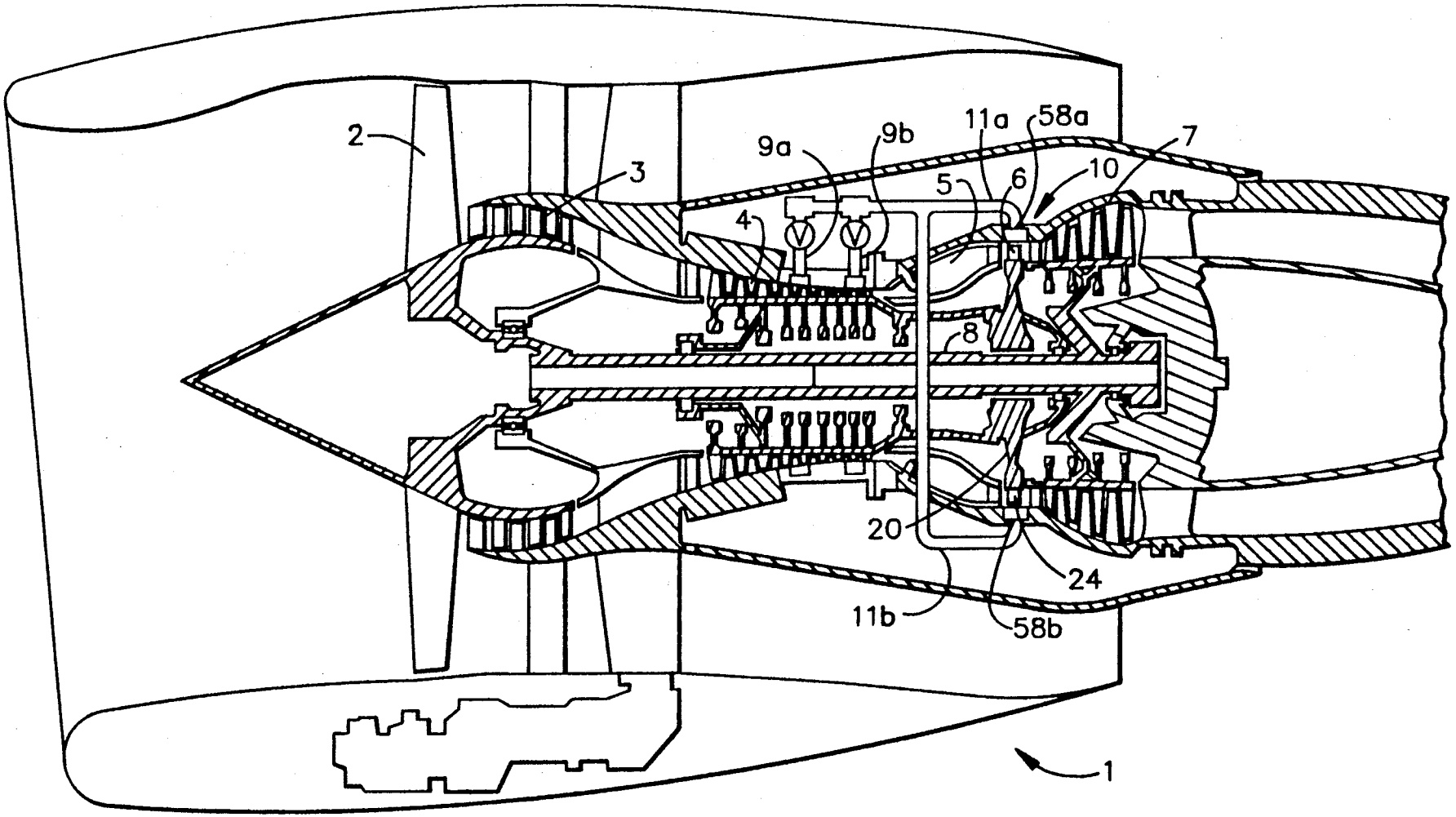
FIG. 1 is a diagrammatic view of an aircraft high bypass turbofan gas turbine engine having a turbine rotor clearance control system in accordance with the present invention.

FIG. 1 illustrates a typical gas turbine engine 1 such as a CFM56 series engine having in serial flow relationship a fan 2, a booster or low pressure compressor (LPC) 3, a high pressure compressor (HPC) 4, a combustion section 5, a high pressure turbine (HPT) 6, and a low pressure turbine (LPT) 7. A high pressure shaft drivingly connects HPT 6 to HPC 4 and a low pressure shaft 8 drivingly connects LPT 7 to LPC 3 and fan 2. HPT 6 includes an HPT rotor 20 having turbine blades 24 mounted at a periphery of rotor 20. A mid-stage air supply **9*a* and a high stage air supply 9*b* (typically drawing air from 4th and 9th stages respectively of HPC 4 in a CFM56 engine) are used as sources for thermal control air flow which is supplied to a turbine blade clearance control apparatus generally shown at 10 through upper and lower thermal control air supply tubes 11*a* and 11*b* respectively. Turbine blade clearance control apparatus 10, including counterflowing upper manifold 58*a* and lower manifold 58*b*, illustrates one form of the preferred embodiment of a counterflowing thermal control apparatus of the present invention and is illustrated in greater detail in FIGS. 2 and 3**.

Figure 2:
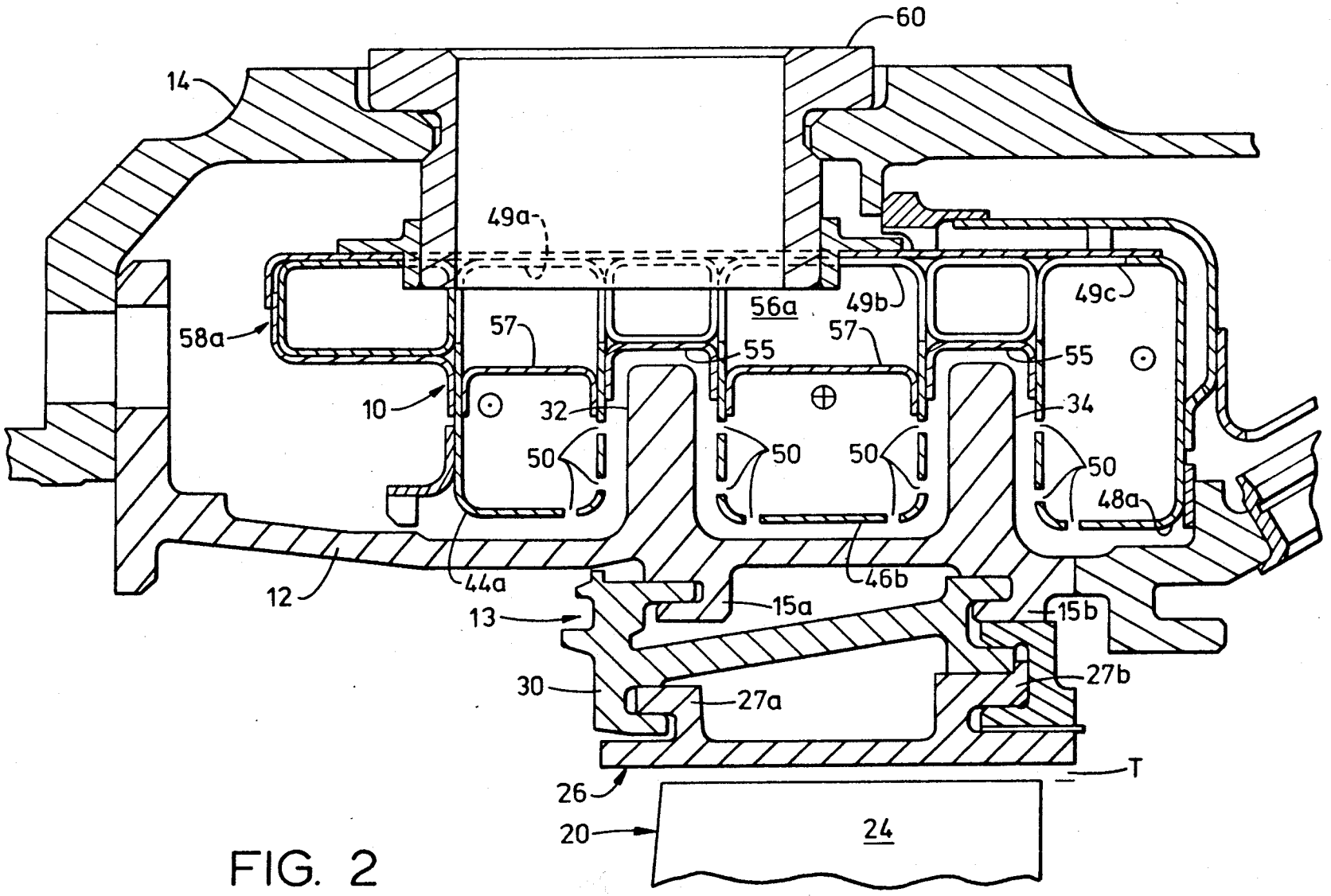
FIG. 2 is a cross-sectional view of a counterflowing thermal clearance control system for a stator assembly in the turbine section of the gas turbine engine in FIG. 1.

Referring now to FIG. 2, turbine blade clearance control apparatus 10 is illustrated using upper manifold **58*a* radially disposed between an annular inner casing 12 and an outer casing 14. A stator assembly generally shown at 13 is attached to inner casing 12 by forward and aft case hook means 15*a* and 15*b* respectively. Stator assembly 13 includes an annular stator shroud 26, preferably segmented, mounted by shroud hook means 27*a* and 27*b* to a preferably segmented shroud support 30. Shroud 26 circumscribes turbine blades 24 of rotor 20 and is used to prevent the flow from leaking around the radial outer tip of blade 24** by minimizing the radial blade tip clearance T.

It is well known in the industry that small turbine blade tip clearances provide lower operational specific fuel consumption (SFC) and thus large fuel savings. In order to more effectively control clearance T with a minimal amount of time lag and thermal control (cooling or heating depending on operating conditions) air flow, forward and aft thermal control rings 32 and 34 respectively are provided. Thermal control rings 32 and 34 are associated with inner casing 12 and may be integral with the respective casing (as illustrated in FIG. 2), may be bolted to or otherwise fastened to the casing, or may be mechanically isolated from but in sealing engagement with the casing. In each embodiment control rings provide thermal control mass to more effectively move shroud 26 radially inward and outward to adjust clearance T.

The embodiment illustrated in FIG. 2 uses thermal control air from stages of HPC 4 in FIG. 1 to cool or heat rings 32 and 34. The present invention supplies thermal control air through a set of counterflowing spray tubes having impingement apertures 50 to cool each axially extending annular section of casing that for the embodiment in FIG. 2 is illustrated by thermal control rings 32 and 34. A heat transfer fluid flowpath in a first circumferential direction is indicated by ⊕ and its corresponding counterflowing flowpath is indicated by ⊖ in FIG. 2.

Figure 3:
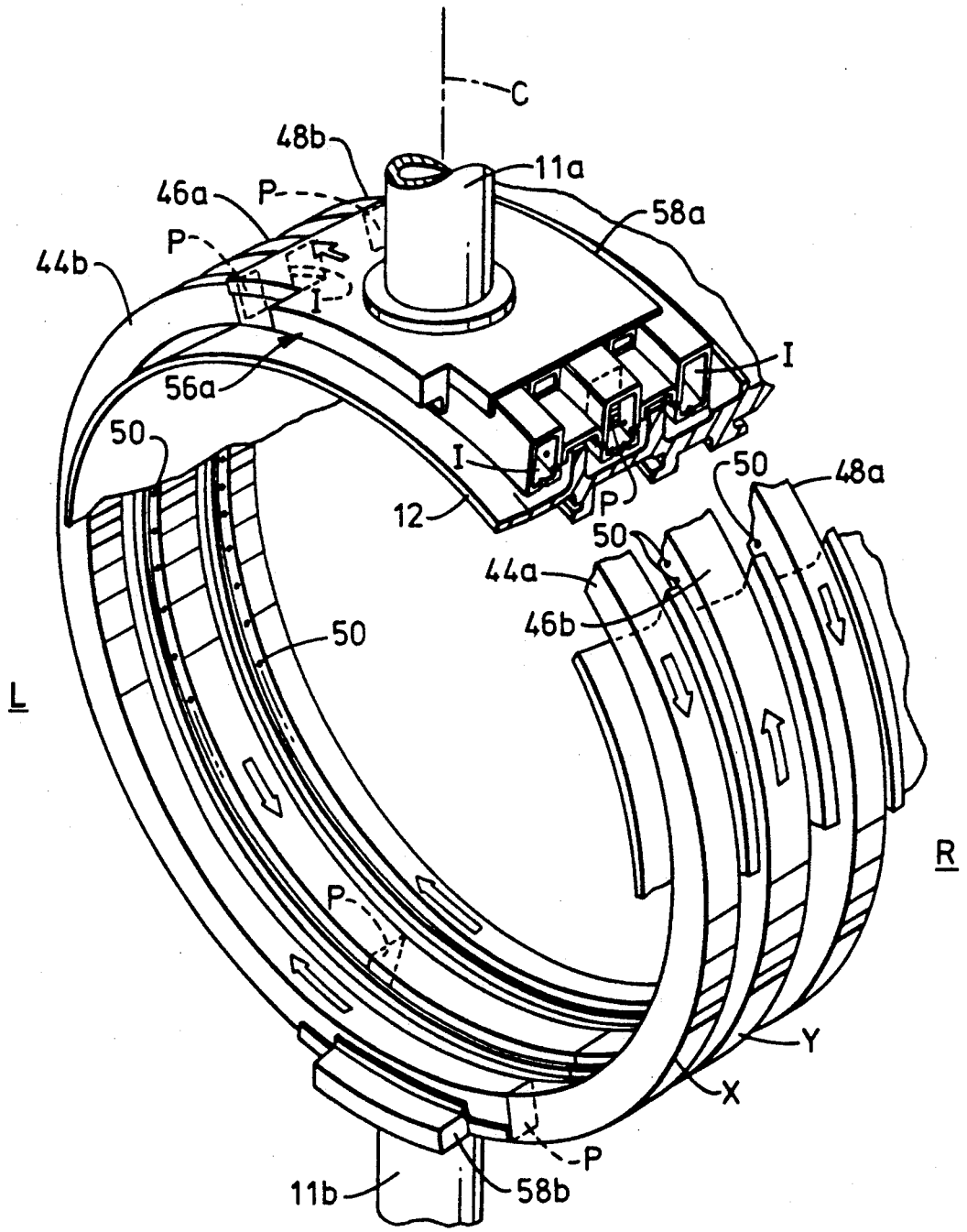
FIG. 3 is a partial cutaway perspective view, forward looking aft, of the manifolds and spray tubes of the clearance control system for the engine and stator assembly shown in FIGS. 1 and 2.

FIG. 3 illustrates the preferred embodiment of the present invention as having two essentially 180° annular counterflowing spray tubes such as an upper forward spray tube **44*a* and a lower forward spray tube 44*b* that are used to form a first continuous 360° heat transfer flowpath X flowing in a first circumferential direction. An upper center spray tube 46*a* and a lower center spray tube 46*b* forms a second continuous 360° heat transfer flowpath Y flowing in a second circumferential direction. Together X and Y comprise a counterflowing thermal control means that provides substantially uniform mass flowrate weighted average heat transfer along the combined heat transfer flowpath assuming that impingement apertures 50** are sized accordingly, by means well known in the art, which in the the preferred embodiment is evenly.

Each of the spray tubes in one of either first or second flowpaths X and Y respectively are supplied with thermal control air by different manifolds, top manifold 58*a* and bottom manifold 58*b*, in the same circumferential direction (clockwise or counterclockwise). Therefore, upper manifold 58*a* supplies thermal control air to upper forward spray tube 44*a* and upper aft spray tube 48*a* in the clockwise direction and to upper center spray tube 46*a* in the counterclockwise direction. Similarly, lower manifold 58*b* supplies thermal control air to lower forward spray tube 44*b* and lower aft spray tube 48*b* in the clockwise direction and to lower center spray tube 46*b* in the counterclockwise direction.

The flowpath and manifold cross-sectional view FIG. 2 is taken through upper manifold 58*a* of FIG. 3. Referring back to FIG. 2; shown are upper forward spray tube 44*a*, lower centerspray tube 46*b*, and upper aft spray tube 48*a* wherein upper forward and aft spray tubes 44*a* and 48*a* provide ⊖ thermal control air for control rings 32 and 34 and lower center spray tube 46*b* provides ⊕ thermal control air for the rings. Impingement apertures 50 provide an impingement means to thermally control rings 32 and 34 in a targeted and efficient manner.

An upper thermal control air plenum generally indicated by 56*a* is provided within upper manifold 58*a* for supplying thermal control air to upper forward and aft spray tubes 44*a* and 48*a*. Upper thermal control air plenum 56*a* also supplies thermal control air to upper center spray tube 46*a* (shown in FIGS. 3 and 4). A boss 60 opens to thermal control air plenum 56*a* providing a connection for a thermal control air supply tube 11*a* as shown in FIG. 1.

Referring now to FIG. 3, a perspective diagrammatic view is shown of a thermal control air manifold means and flowpaths of the preferred embodiment employing two oppositely disposed upper and lower manifolds 58*a* and 58*b* that receive thermal control air from corresponding upper and lower thermal control air supply tubes 11*a* and 11*b*. Upper manifold 58*a* supplies thermal control air to corresponding upper forward, center, and aft spray tubes 44*a*, 46*a*, and 48*a* respectively. Lower manifold 58*b* supplies thermal control air to corresponding lower forward, center, and aft spray tubes 44*b*, 46*b*, and 48*b* respectively. Forward and aft spray tubes, supplied by one manifold, are disposed in a first 180° sector, R or L on either side of center reference line C and the center spray tube supplied by the same manifold lies in the corresponding opposite 180° sector.

The spray tubes have inlets I at their corresponding supply manifolds and plugs P near the corresponding opposite manifold such that each spray tube essentially provides a 180° heat transfer fluid flowpath that flows in one circumferential direction. Spray tubes include impingement apertures 50 so that each set of adjacent spray tubes, forward and center set and aft and center set, in each sector provide a set of counterflowing heat transfer flowpaths and means for effecting heat transfer (cooling in the illustrated embodiments) between rings 32 and 34 of inner casing 12 and the heat transfer fluid.

As can readily be seen in FIG. 3 the flowpaths within the spray tubes are manifolded to provide parallel counterflowing heat transfer flowpaths that have the same temperature thermal control air (heat transfer fluid) supplied from their corresponding supply manifolds 58*a* and 58*b*. The temperature drop from inlet I to plug P is substantially the same but in opposite circumferential directions in each set of counterflowing flowpaths. Therefore at any point around inner case 12, control ring 32 or 34 is being impinged by thermal control air having the same mass flowrate weighted average temperature from each one of the set of counterflowing spray tube flowpaths, assuming mass flow rates through respective impingement apertures 50 are the same in each set of spray tubes.

For example suppose air is supplied at 400° F. to the manifold and has a 50° F. drop along the circumferential length of the spray tubes through its corresponding 180° sector. The mass flowrate weighted average temperature sprayed on the casing and control ring would be 375° F. at any circumferential location being cooled. On the other hand if the heat transfer fluid was not counterflowed and only one inlet feed manifold was used, there would be a maximum temperature gradient from 400° F. to 350° F. between opposite ends of the spray tubes.

It can be readily seen that if the circumferential variation in the two adjoining spray troes would be different then mass flow rates of thermal control air impinging the rings could be adjusted to obtain a substantially constant mass flow rate weighted average temperature of the thermal control air used for impingement around the thermal control ring.

Figure 4:
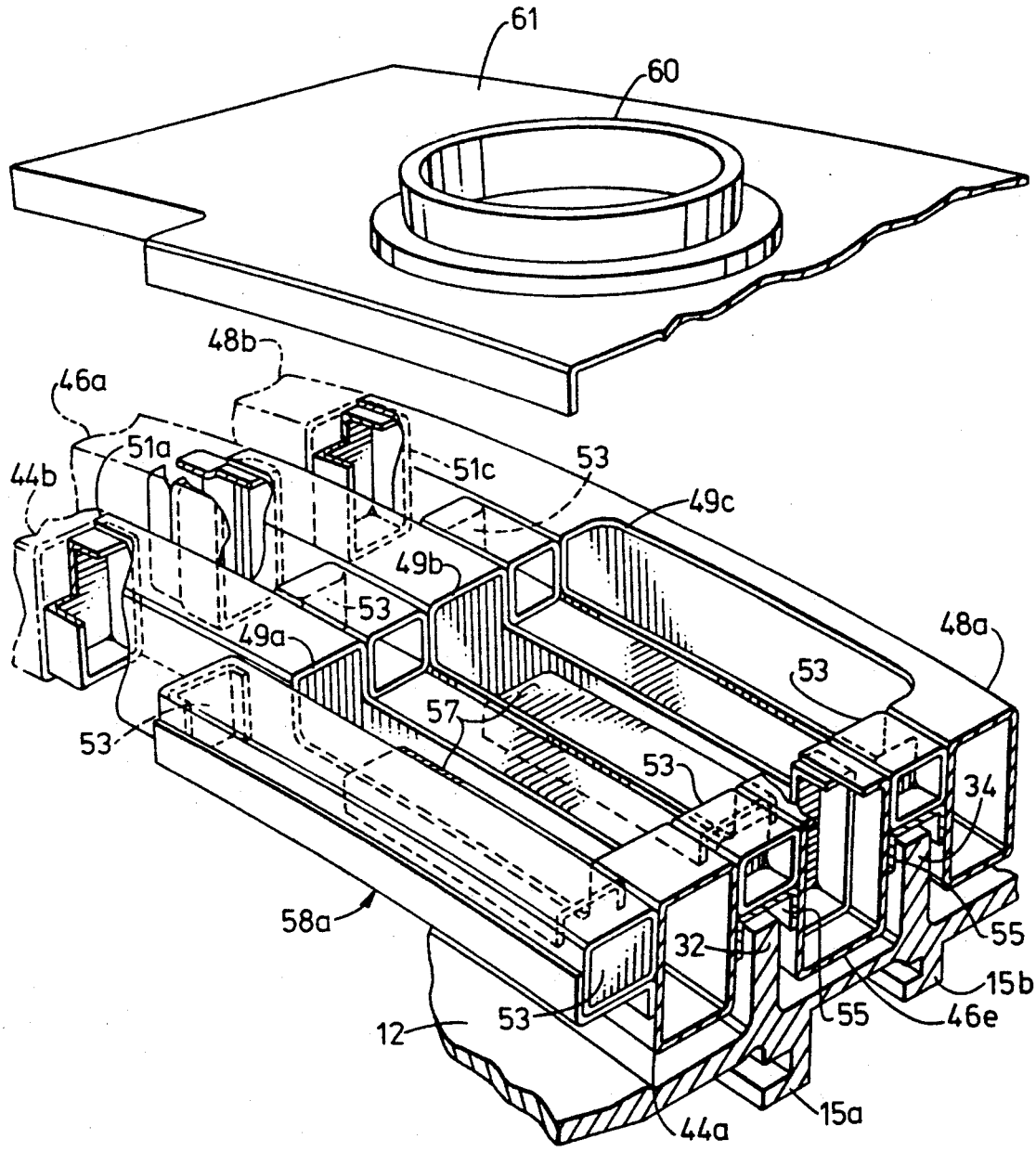
FIG. 4 is an exploded perspective view of the manifold and counterflowing means of the thermal clearance control system shown in FIG. 2.

FIG. 4 illustrates, in greater detail, one embodiment of the construction of manifold 58*a*. Scalloped out openings 49*a*, 49*b*, and 49*c* in upper forward, center, and aft spray tubes 44*a*, 46*a*, and 48*a* respectively provide a thermal control airflow passage into these spray tubes fed by manifold 58*a* through respective inlets I in FIG. 3. Side caps 53 and inverted wall channels 55, preferably made of sheet metal, are contoured to fit between and are attached, preferably brazed, to adjoining spray tubes. Baffles 57 in the form of inverted channels are disposed in scalloped out openings 49*a* and 49*b* to minimize pressure losses associated with the system by preventing direct discharge of thermal control air into tubes 44*a* and 46*b* from boss 60 mounted in a top cover 61 of manifold 58*a*. Bottom manifold 58*b* is constructed in a similar manner.

Upper forward and aft spray tubes 44*a* and 48*a* respectively meet and are in abutting relationship with their corresponding lower forward and aft spray tubes 44*b* and 48*b* at their respective upper ends 51*a* and 51*c*. Upper center spray tube 46*a* is placed in the same relationship with its corresponding lower center spray tube 46*b* (not shown) near its end 46*e* thereby forming substantially continuous heat transfer circuits of thermal control air.

Figure 5:
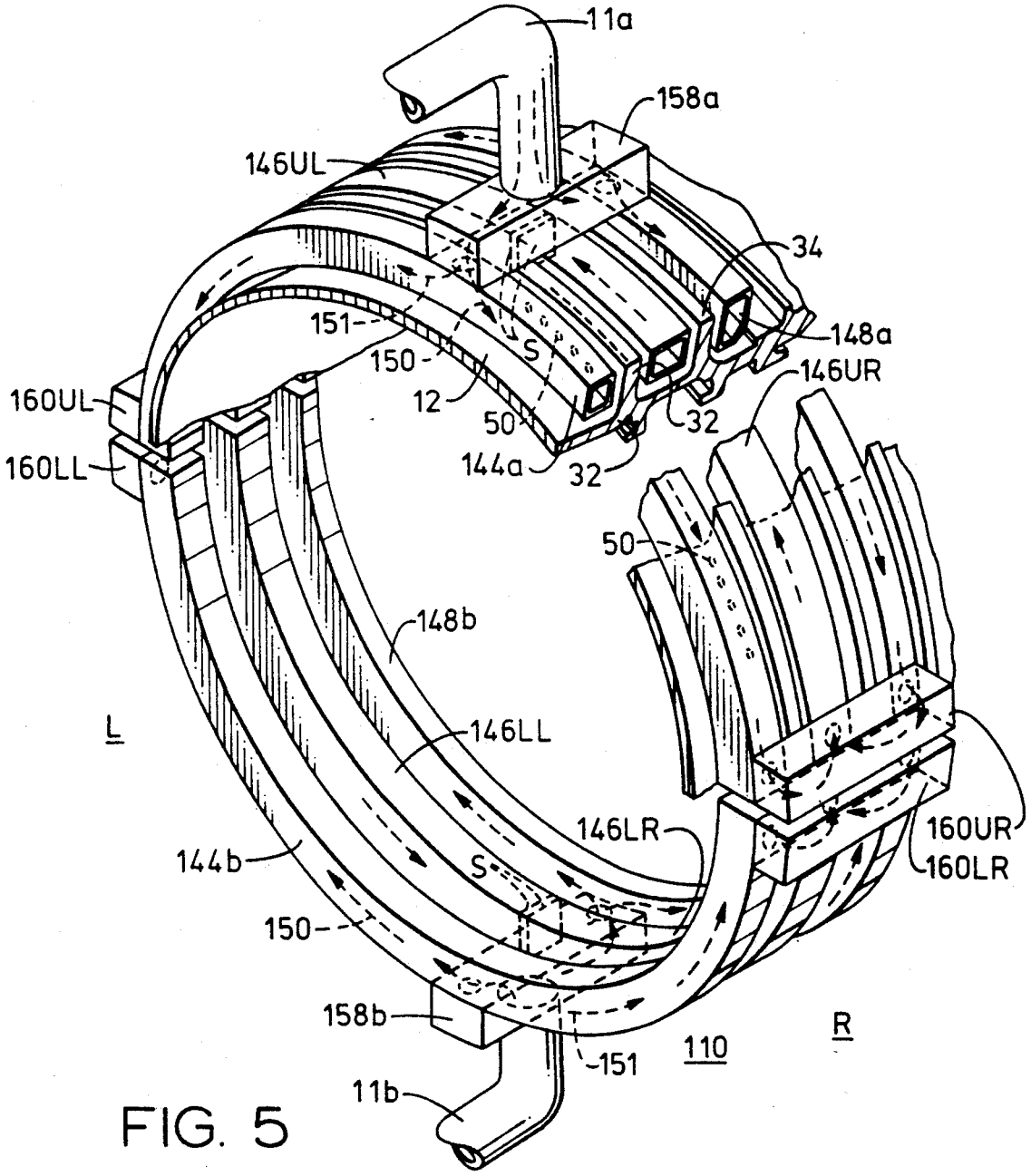
FIG. 5 is a partial perspective view of the manifolds and spray tubes of an alternate embodiment of the clearance control system shown in FIG. 3.
Figure 6:
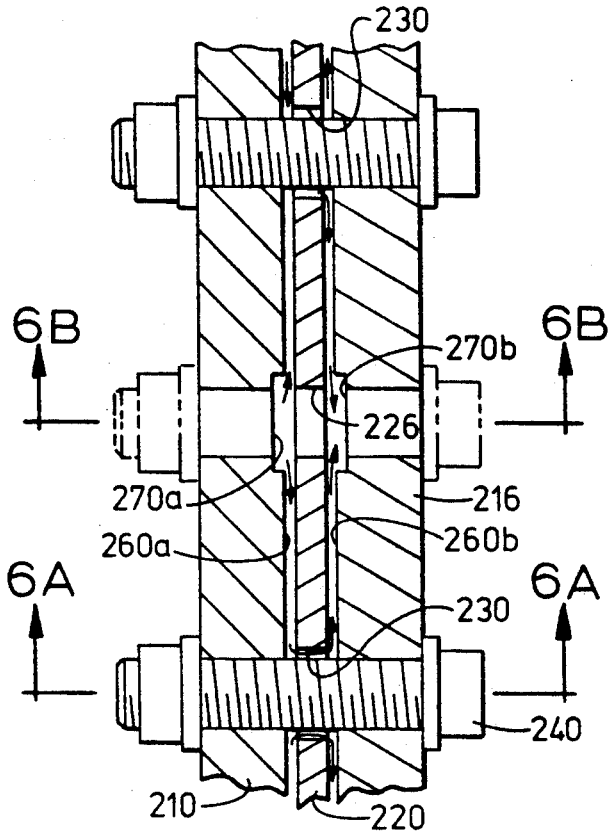
FIG. 6 (PRIOR ART)
FIG. 6 is a top planform view of a prior art flange assembly for a thermal control system.
Figure 6A:
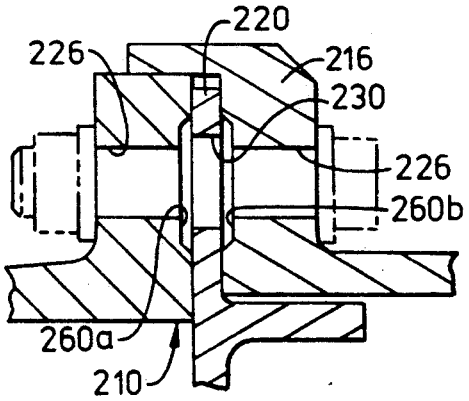
FIG. 6A (PRIOR ART)
FIG. 6*a* is a side cutaway view of the prior art flange assembly taken through section AA in FIG. 6.
Figure 6B:
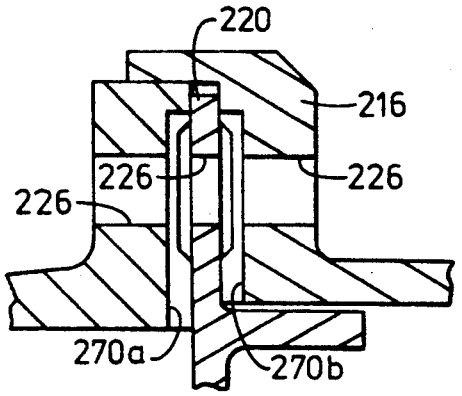
FIG. 6B (PRIOR ART)
FIG. 6*b* is a side cutaway view of the prior art flange assembly taken through section BB in FIG. 6.

An alternative embodiment, illustrated in FIG. 5, provides an alternative turbine blade clearance control apparatus generally shown at 110 having sets of counterflowing flowpaths that are in serial flow relationship. An upper thermal control air plenum 158*a*, effective to receive thermal control air from upper thermal control air supply tube 11*a*, is in fluid supply communication with the middles of semi-circular upper forward spray tube 144*a* and upper aft spray tube 148*a* so as to cause the thermal control air to flow in opposite circumferential directions indicated by clockwise arrow 150 and counterclockwise arrow 151. Similarly a lower thermal control air plenum 158*b*, effective to receive thermal control air from lower thermal control air supply tube 11*b*, is in fluid supply communication with the middles of semi-circular lower forward spray tube 144*b* and lower aft spray tube 148*b* so as to cause the thermal control air to flow in opposite circumferential directions indicated by clockwise arrow 150 and counterclockwise arrow 151.

An upper right center spray tube 146UR extends through 90° terminating at an end s and is in serial flow receiving communication with corresponding upper forward spray tube 144*a* and upper aft spray tube 148*a* by way of dual thermal control air transfer tube 160UR while an upper left center spray tube 146UL extends throughs 90° terminating at an end s and is in serial flow receiving communication with corresponding upper forward spray tube 144*a* and upper aft spray tube 148*a* by way of dual thermal control air transfer tube 160UL. A lower right center spray tube 146LR extends through 90° terminating at an end s and is in serial flow receiving communication with corresponding lower forward spray tube 144*b* and lower aft spray tube 148*b* by way of dual thermal control air transfer tube 160LR while a lower left center spray tube 146LL extends throughs 90° terminating at an end s and is in serial flow receiving communication with corresponding lower forward spray tube 144*b* and lower aft spray tube 148*b* by way of dual thermal control air transfer tube 160LL. Impingement apertures 50 are disposed in spray tubes for impinging thermal control air on thermal control rings 32 and 34.

This arrangement provides two sets of serial type counterflowing heat transfer flowpaths for each of four quadrants of engine casing 12 for impinging thermal control air on forward and aft rings 32 and 34 in order to control their thermal growth and shrinkage. The average temperature of thermal control air impinged on the casing is lower because the temperature drop across the flowpath is greater than that of the drop across the parallel flowpaths shown in FIGS. 2 and 3.

As noted earlier the mass flowrate weighted average temperature should be substantially the same around the rings or other sections of casing to be thermally controlled. In order for this optimum condition to be met the mass flowrate of heat transfer fluid or thermal control air must be the same through all the impingement apertures. Therefore the cross-sectional area of the spray tubes and their impingement apertures must be carefully designed and sized, keeping in mind that the velocity of the thermal control air as it travels downstream through the spray tube decreases and its static pressure increases.

A constant cross-sectional area for the spray tube and a constant impingement aperture area may be used if the ratio is chosen correctly. It has been found that a thermal control air velocity through the spray tubes of between Mach Number 0.1 to 0.05, having a total to static pressure ratio ($p_T/p_S$) of about 1.00, is preferable. Alternatively a circumferentially varying impingement aperture width or density may be used to maintain a uniform mass flow rate for impingement thermal control.

While the preferred embodiment of our invention has been described fully in order to explain its principles, it is understood that various modifications or alterations may be made to the preferred embodiment without departing from the scope of the invention as set forth in the appended claims.

We claim:

1. A thermal control apparatus for a gas turbine engine casing, said thermal control apparatus comprising;

at least two axially spaced apart circumferentially disposed continuous flowpaths in heat transfer communication with an axially extending section of the casing, a means of counterflowing a heat transfer fluid through said flowpaths such that said fluid in one flowpath flows in a clockwise direction and said fluid in the other of said flowpaths flows in a counterclockwise direction, and a means for effecting heat transfer between said fluid and said casing section.

2. A thermal control apparatus as claimed in claim 1 wherein said flowpaths are in parallel fluid flow communication.

3. A thermal control apparatus as claimed in claim 2 wherein said counterflowing means comprises an axially extending manifold having clockwise and counterclockwise facing inlets in fluid supply communication with corresponding ones of said clockwise and counterclockwise flowing flow paths.

4. A thermal control apparatus as claimed in claim 3 further comprising two manifolds supplying two corresponding sets of said counterflowing flowpaths.

5. A thermal control apparatus as claimed in claim 4 further comprising two sectors about the engine casing wherein each of said manifolds supplies said fluid to flowpaths in each of said sectors such that one of said manifolds supplies said clockwise flowing flowpaths and the other of said manifolds supplies said counterclockwise flowing flowpaths extending through each one of said sectors.

6. A thermal control apparatus as claimed in claim 5 further comprising at least one annular thermal control ring associated with said section of the engine casing axially disposed between said set of said counterflowing flowpaths and a support means tying an annular stator assembly to said thermal control ring such that expansion and contraction of said thermal control ring will cause a corresponding expansion and contraction of said stator assembly.

7. A thermal control apparatus as claimed in claim 6 wherein said stator assembly comprises a segmented annular stator shroud.

8. A thermal control apparatus as claimed in claim 7 wherein said means for effecting heat transfer between said heat transfer fluid and said casing is by impingement and comprises circumferentially disposed spray tubes containing said flowpaths and impingement apertures in said spray tubes arranged to impinge said fluid onto said thermal control ring to effect thermal control of said thermal control ring.

9. A thermal control apparatus as claimed in claim 5 further comprising:

forward and aft axially spaced apart thermal control rings associated with said section of the engine casing, a first set and second set of two axially spaced apart circumferentially disposed counterflowing continuous heat transfer flowpaths in heat transfer communication with an axially extending section of the casing, said first and second sets of counterflowing continuous heat transfer flowpaths comprise three axially spaced apart circumferentially disposed counterflowing continuous heat transfer flowpaths interdigitated with said thermal control rings, a support means tying forward and aft ends of an annular stator assembly to corresponding ones of said forward and aft thermal control rings such that expansion and contraction of said thermal control rings will cause a corresponding expansion and contraction of said stator assembly, said means of counterflowing comprises a means to flow heat transfer fluid through said first and third heat transfer flowpaths in a first circumferential direction and through said second heat transfer flowpath in a second counterflowing direction, and said first and second heat transfer flowpaths are arranged to effect heat transfer between heat transfer fluid and said first thermal control ring and said third and second flowpaths are arranged to effect heat transfer between heat transfer fluid and said second thermal control ring.

10. A thermal control apparatus as claimed in claim 9 wherein said stator assembly comprises a segmented annular stator shroud.

11. A thermal control apparatus as claimed in claim 10 wherein said means for effecting heat transfer between said heat transfer fluid and said rings comprises circumferentially disposed spray tubes containing said flowpaths and impingement apertures in said spray tubes arranged to spray said fluid onto said thermal control rings to effect thermal control of said thermal control rings.

12. A gas turbine engine comprising;

an annular engine casing surrounding a portion of the engine's rotor, at least two axially spaced apart circumferentially disposed flowpaths in heat transfer communication with an axially extending section of the casing, a means of counterflowing air through said flowpaths such that the air in one flowpath flows in a clockwise direction and the air in the other of said flowpaths flows in a counterclockwise direction, a compressor means and a means for supplying air from said compressor to said means of counterflowing air, and a means for effecting heat transfer between air and said casing section.

* * * * *